US005628918A

United States Patent [19]

Mastalski

[11] Patent Number: 5,628,918

[45] Date of Patent: May 13, 1997

[54] METHOD FOR SUPPORTING A PHOTORECEPTOR DURING LASER ABLATION

[75] Inventor: Henry T. Mastalski, Webster, N.Y.

[73] Assignee: Xerox Corporation, Stamford, Conn.

[21] Appl. No.: 432,564

[22] Filed: May 1, 1995

[51] Int. Cl.[6] ..... G03G 5/00

[52] U.S. Cl. ..... 216/8; 216/65

[58] Field of Search ..... 216/8–10, 65; 219/121.68, 121.69, 121.84; 384/100, 114, 116

[56] References Cited

U.S. PATENT DOCUMENTS

| | | | |
|---|---|---|---|
| 4,671,848 | 6/1987 | Miller et al. | 156/643 |
| 4,766,788 | 8/1988 | Yashiki et al. | 82/30 |
| 4,797,009 | 1/1989 | Yamazaki | 384/100 |
| 4,851,026 | 7/1989 | Kuster et al. | 65/273 |
| 4,856,234 | 8/1989 | Goins | 51/284 R |
| 5,324,608 | 6/1994 | Gerriets et al. | 430/60 |
| 5,378,315 | 1/1995 | Hendrix et al. | 216/92 |
| 5,403,627 | 4/1995 | Wilbert et al. | 216/65 X |

FOREIGN PATENT DOCUMENTS

| | | |
|---|---|---|
| 3-144458 | 6/1991 | Japan . |
| 3-194131 | 5/1993 | Japan . |

*Primary Examiner*—Thi Dang

*Attorney, Agent, or Firm*—Zosan S. Soong

[57] ABSTRACT

A method is disclosed comprising: (a) rotating a hollow cylindrical substrate having a coating thereon; (b) employing a gas bearing around the circumference of the rotating substrate along a portion of the length of the substrate to provide support to the substrate during its rotation; and (c) removing a portion of the coating.

12 Claims, 5 Drawing Sheets

METHOD FOR SUPPORTING A PHOTORECEPTOR DURING LASER ABLATION

This invention relates generally to a method for supporting a substrate during the removal of coating material therefrom, and more specifically to the use of a gas bearing to support a rotating photoreceptor during laser ablation.

In electrophotography, and particularly in xerographic copying machines, coated substrates such as photoreceptor belts or cylindrical photoreceptor drums are common. Photoreceptor embodiments include at least one coating of photosensitive material, which can be formed on the photoreceptor by known techniques such as immersion or dip coating.

The peripheral ends of a coated photoreceptor are used to engage with flanges in a copier's drive mechanism and/or to support a developer housing. If the developer housing rides on the coated area at one end of the drum, the coating material is rubbed off and contaminates various components in the machine such as the cleaning system and any optical exposure systems employed in the machine. Also, the coating can interfere with devices that are designed to electrically ground the drum by merely riding on the outer surface at one end of the drum. Thus, both the outer and inner peripheral ends of a photoreceptor must be free of coating material.

Conventionally, the ends of a photoreceptor are masked before coating to prevent them from being coated. In dip coating, the upper end of the photoreceptor drum might be kept free of coating material by orienting the drum vertically and dipping the drum into a bath of coating material to a predetermined depth. However, the coating formed over the lower end of the photoreceptor must still be removed, such as by mechanically wiping the lower end and/or by applying solvents to it.

In one coating removal technique, a predetermined portion of a coating on a photoreceptor is treated to remove at least part of the coating by directing high energy radiation such as a laser beam and a number of fluid jets at the coating to remove at least part of the coating. This process will be referred to as "laser ablation." The laser ablation process functions to effectively remove at least part of a predetermined portion of a coating without the need for chemical or mechanical treatments. The process is useful for treating cylindrical photoreceptor drums.

During laser ablation, the coated substrate is rotated at high speeds. However, a problem is that a rotating cylindrical substrate which is supported only at one end, i.e., a cantilevered state, may sway when the rotation speed is high and/or when the substrate has a relatively small diameter. Swaying of the substrate during for example laser ablation may affect the precision of the ablation process.

The following documents may be of interest:

Japanese Publication No. 3-144,458 discloses a process that attempts to remove coatings from the ends of a photoreceptor without mechanical or chemical treatment. A laser beam from an yttrium-aluminum-garnet laser is irradiated at the end portions of a photoreceptor drum to burn or sublimate the photoreceptor coating.

Japanese Publication No. 3-194,131 discloses a similar process in which laser energy is directed at the ends of a photoreceptor in an effort to completely remove the coating.

Miller et al., U.S. Pat. No. 4,671,848 discloses a method for removing a dielectric coating from a conducting material, wherein a high energy radiation source, such as a laser source, is focused in a region having a predefined relationship with the coating of the conducting material.

The following documents illustrate the structure and use of air bearings: Yamazaki, U.S. Pat. Nos. 4,797,009; Goins, 4,856,234; and Yashiki et al., 4,766,788.

SUMMARY OF THE INVENTION

It is an object of the instant invention to provide a contactless support to a rotating coated drum.

These objects and others are accomplished in embodiments by providing a method comprising:

(a) rotating a hollow cylindrical substrate having a coating thereon;

(b) employing a gas bearing around the circumference of the rotating substrate along a portion of the length of the substrate to provide support to the substrate during its rotation; and (c) removing a portion of the coating.

BRIEF DESCRIPTION OF THE DRAWINGS

Other aspects of the present invention will become apparent as the following description proceeds and upon reference to the Figures which represent preferred embodiments.

Unless otherwise noted, the same reference numeral in the Figures refers to the same or similar feature.

DETAILED DESCRIPTION

Figure 1:
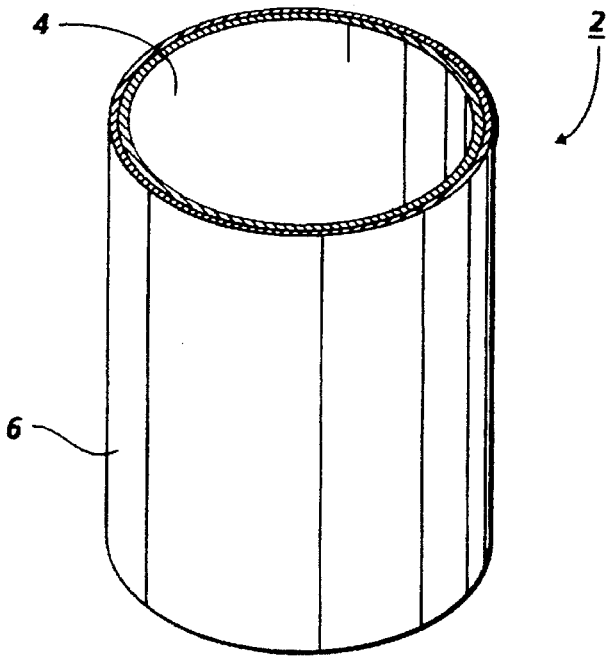
FIG. 1 shows a cylindrical photoreceptor having an outer coating to be treated.

For purposes of illustration, the process according to the invention will be described with reference to the treatment of a coated cylindrical photoreceptor. Referring to FIG. 1, a partially processed photoconductor drum 2 is shown. Drum 2 includes a rigid cylindrical substrate 4 having an outer coating 6 formed over the substrate. Substrate 4 can be made of any suitable material such as aluminum, nickel, zinc, chromium, conductive paper, stainless steel, cadmium, titanium, metal oxides, polyesters such as MYLAR®, and the like. Substrate 4 can be formed as one layer or as a plurality of layers, for example as a conductive layer coated over an insulating layer. The thickness of substrate 4 can vary widely depending on the intended use of the photoreceptor, and preferably is from about 65 micrometers to about 5 millimeters thick, most preferably from about 0.05 millimeter to about 2 millimeters thick.

The process removes various types of known photoreceptor coatings. Coating 6 can include one or a plurality of layers, and typically will include multiple layers such as an electrically conductive ground plane, a blocking layer, an adhesive layer, a charge generating (photogenerating) layer, a charge transporting layer and an overcoat layer. The process removes at least part of one coating layer. Preferably, all of the coating layers present at the outer and inner peripheral end regions of the photoreceptor are removed. In embodiments of the present invention, the coating along the entire length of the photoreceptor may be removed so that the substrate may be recycled.

The layers of coating 6 are formed using well known techniques and materials. For example, coating 6 can be applied to substrate 4 by vacuum deposition, immersion, spray coating, or dip coating. Dip coating or spray coating are preferred. Suitable coating techniques and materials are illustrated in U.S. Pat. Nos. 5,091,278, 5,167,987 and 5,120,628, the entire disclosures of which are totally incorporated herein by reference. The process of the invention can be carried out in conjunction with the coating process, after the coating has partially hardened. Preferably, laser ablation is performed after the coating has substantially or fully hardened.

Coating 6 preferably includes, as a photoconductive material, one or a plurality of layers of selenium, metal alloys, and/or organic resins carrying photoconductive materials. Organic photoconductor coatings are preferred. Such coatings include a photoconductive material such as pigments including dibromoanthanthrone, metal-free and metal phthalocyanines, halogenated metal phthalocyanines, perylenes, and azo pigments, carried in a suitable organic binder resin. Examples of useful organic binder resins include polycarbonates, acrylate polymers, vinyl polymers, cellulose polymers, polysiloxanes, polyamides, polyurethanes, polyesters, and block, random or alternating copolymers thereof.

Figure 2:
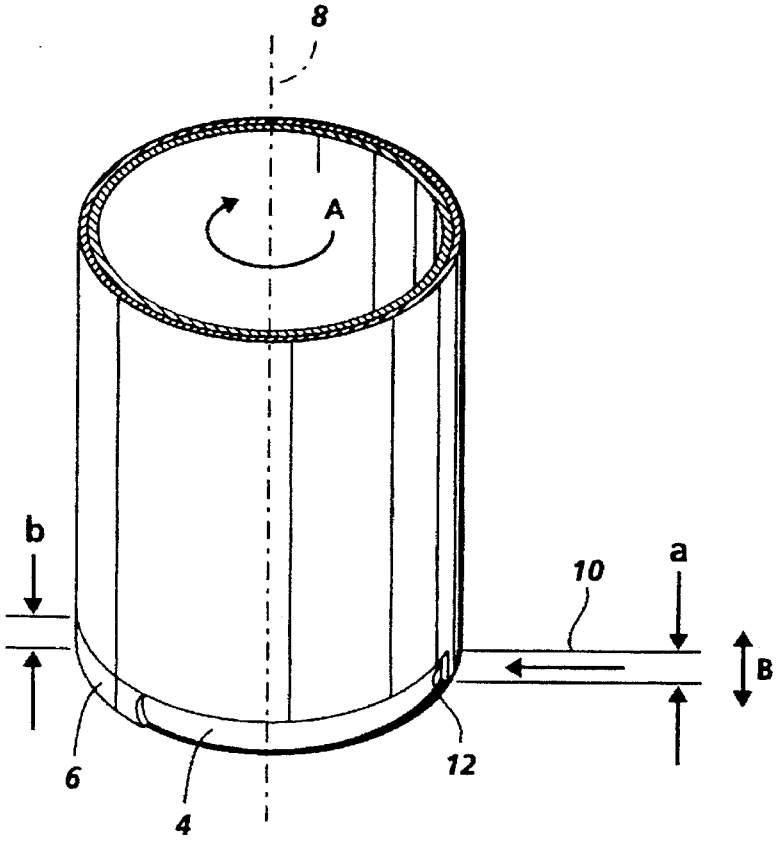
FIG. 2 illustrates the removal of a portion of the coating using laser radiation.

Referring to FIG. 2, drum 2 is mounted such that its longitudinal axis 8 is vertically or horizontally oriented. Drum 2 is preferably mounted using a conventional chucking device coupled to a drive (not shown), so that drum 2 can be rotatably driven about longitudinal axis 8 in the direction of arrow A. The photoreceptor is preferably rotated about axis 8 during the removal of the coating. A rotational speed of from about 400 rpm to about 4000 rpm is preferred, and especially from about 2,000 rpm to about 4,000 rpm.

As drum 2 is rotated, a laser beam 10 of width "a" from a conventional $CO_2$ laser (not shown) is directed at a predetermined portion of coating 6. The laser used in the process is preferably a continuous wave carbon dioxide laser. $CO_2$ lasers provide a laser beam having a wavelength that is particularly well absorbed by plastic binder resins commonly present in one or more layers of known photoreceptors. A $CO_2$ laser emitting a beam at a wavelength of about 10.6 micrometers has been found to work well for organic photoconductor films having polycarbonate binders. Carbon dioxide continuous wave lasers are commercially available and require no special modification to be effective in carrying out the ablation. Alternately, among others, a pulsed beam $CO_2$ laser, yttrium aluminum garnet (YAG) laser, or excimer laser could be used to carry out the laser ablation process.

The laser should have sufficient power to remove a desired amount of the particular coating to be treated. The power of the $CO_2$ laser should be selected depending on the type of substrate present in the photoreceptor. Where the photoreceptor includes an aluminum substrate, a laser having a power of from about 800 W to about 2000 W, more preferably from about 1000 W to about 1500 W, has been found to provide preferred results. With a nickel substrate, a laser having a power of from about 100 W to about 400 W is preferred.

The laser beam should have a sufficient watt density to ablate the photoreceptor coating. An optical system is preferably used to concentrate the laser beam and provide the required watt density for a particular photoreceptor coating. However, laser beam systems are available that may not require an optical system to provide a laser beam having a sufficient watt density to ablate a photoreceptor coating. The focal length, focus, and angle of incidence of the laser affect the laser ablation process, and can be selected depending on the particular coating and the results intended. A focal length of about 5 inches and a surface focus or slightly off-surface focus are preferred. Most preferably, the laser has a focus tolerance of about ±0.75 mm from the point of sharp focus, in either direction.

The predetermined portion of coating 6 to be treated has a desired width "b". To provide a suitable coating free area to support a developer housing or flange for a drive mechanism, width "b" is typically about 1 cm wide. The process could be used to ablate other widths of a photoreceptor coating. It may also be desirable to remove bands of the coating in one or more locations on the photoreceptor, or to remove circular or other shaped patterns of the coating.

At a given moment during laser ablation, laser beam 10 impinges on a spot 12 such that at least part of the coating material in the area of spot 12 is rapidly heated and vaporized by laser beam 10. Part of coating 6 is typically melted by laser beam 10; this molten coating material is forced off of drum 2 by the action of a cross-jet fluid.

One fluid jet used in the ablation process is a cross-jet of fluid Another fluid jet used with the ablation process is coaxial with the laser beam. A combination of the two is preferred for laser ablation. Conventional apparatus for supplying cross and coaxial fluid jets, which are commercially available, may be employed in embodiments of the instant invention. The laser vaporizes and removes at least part of the coating. As discussed above, the laser will often melt but not vaporize certain other materials in the coating. By applying a high velocity stream of cross-jet fluid to the coating during laser treatment, the molten coating material is forced off the photoreceptor in a controlled manner. This permits all of the coating material to be removed from the predetermined region of the photoreceptor coating, without subsequent chemical or mechanical treatment. Cross-jet gas preferably has a pressure of from about 20 psi to about 400 psi, more preferably from about 100 psi to about 300 psi.

The supplying of a coaxial fluid jet around the laser beam during laser treatment prevents debris from backing up into the laser during the ablation process. The coaxial fluid jet travels around the outside of the laser beam in the same direction as the beam. This protects the laser and increases the online production time of the laser ablation system. A coaxial gas jet preferably has a pressure in the range of from about 5 psi to about 150 psi, more preferably from about 20 psi to about 60 psi, measured near the point at which the gas exits from the jet nozzle. It will be understood that the pressure of the gas can be varied by controlling the nozzle orifice size and the speed of the gas exiting the gas jet nozzle. A suitable nozzle diameter is about 1.5 mm, but various diameters are useful. Preferably, the process uses both cross and coaxial gas jets.

The gas used in the cross-jet and/or coaxial jet is preferably air, but can be other gases such as nitrogen gas or pure oxygen gas, depending on the coating material and other laser ablation conditions. For example, if a highly reactive or potentially explosive coating is to be removed, an inert cross-jet or coaxial jet gas such as nitrogen gas can be used. Conversely, if additional oxidation of the coating during the laser ablation process is desired, pure oxygen gas or other reactive gas mixtures can be used.

In an alternative embodiment, a liquid cross-jet could be used to assist the removal of the ablated photoreceptor coating. The liquid jet should have an orientation and pressure sufficient to impart about the same pressure on the ablated coating as the cross-jet gas described above.

As drum 2 rotates during the laser ablation process, a circumferential strip of coating material 6 substantially the same width as the width "a" of the laser beam is removed, exposing the underlying cylindrical photoreceptor substrate 4. The laser and gas jets are directed at the predetermined portion of coating 6 until the intended amount of coating has been removed.

The laser beam can have a width equal to the predetermined portion to be treated, or it can be narrower, in which case the laser beam is preferably translated across the width of the predetermined portion of the coating during the rotation of the photoreceptor. In a preferred embodiment, the width "a" of laser beam 10 is less than the width "b" of the predetermined portion of coating 6 to be treated. The laser source is mounted on a carriage (not shown) so as to be reciprocatable parallel to axis 8 during rotation of drum 2. To ablate the coating, as drum 2 rotates, laser beam 10 and the coaxial and cross-jet fluids are impinged on the inboard edge of the circumferential strip and then translated toward the bottom edge of photoreceptor drum 2, so as to cover the width "b" of the predetermined portion of coating 6. Alternately, laser beam 10 and the fluid jets can be translated from the outer edge of drum 2 toward the inboard edge of the circumferential strip. Preferably, laser ablation begins at the inboard edge of the predetermined portion of the coating to be removed, and the laser beam is translated toward the end of the photoreceptor. The coaxial fluid jet, if used, moves with the laser beam as the beam is translated over the photoreceptor coating. The cross-jet of fluid, if used, can be moved with the laser beam, or it can be maintained in a stationary position. The fluid jets are preferably directed at the photoreceptor to push the ablated coating off the end of the photoreceptor during the treatment. This helps prevent the ablated coating material from resettling on the untreated portion of the coating. A suction exhaust system (not shown) is preferably used to help capture the particulate debris and remove it from the treatment area.

The translation speed of laser beam 10 preferably is from about 0.25 millimeter per second to about 12.5 millimeters per second. A single pass over the coating is preferred. Laser beam 10 can be translated across the width "b" of the predetermined portion of coating 6 more than once if needed to remove coating material not removed by the first pass of the laser beam.

Optionally, if laser beam 10 has a width "a" less than the width "b" of the circumferential strip, laser beam 10 can be rapidly oscillated up and down in the directions of arrow B to cover the desired width "b" of coating 6 with the laser beam at spot 12.

Figure 3:
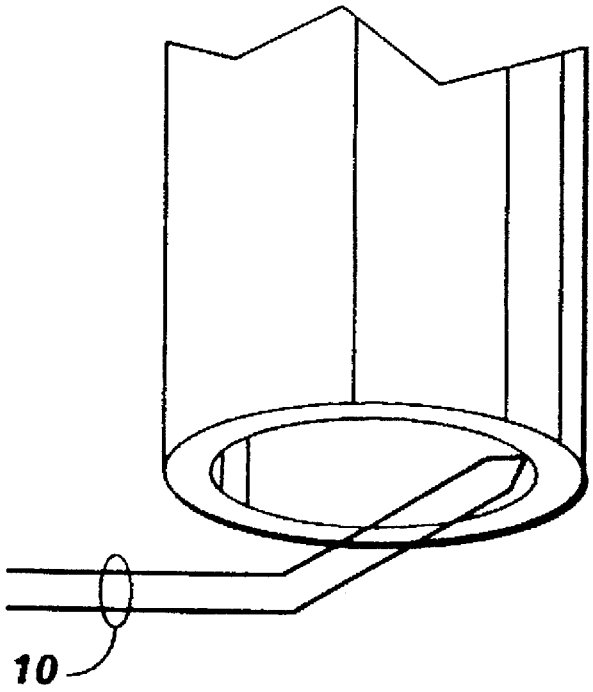
FIG. 3 is a partial plan view showing the removal of a coating from an inner portion of a cylindrical photoreceptor.

When the desired amount of coating 6 has been removed from the outer predetermined surface(s) of drum 2, the laser and fluid jets can be stopped and reoriented to impinge upon any selected inner surface(s) of drum 2. In the case of a cylindrical photoreceptor, the outer and inner peripheral surfaces of the photoreceptor are preferably treated to remove the coating from the photoreceptor. FIG. 3 is a partial plan view showing the removal of a coating by laser beam 10 from an inner portion of a cylindrical photoreceptor according to the laser ablation embodiment of the invention. Once the inner and/or outer predetermined portions have been treated, the process is stopped and drum 2 is removed from the chucking device for further processing or use.

Figure 4:
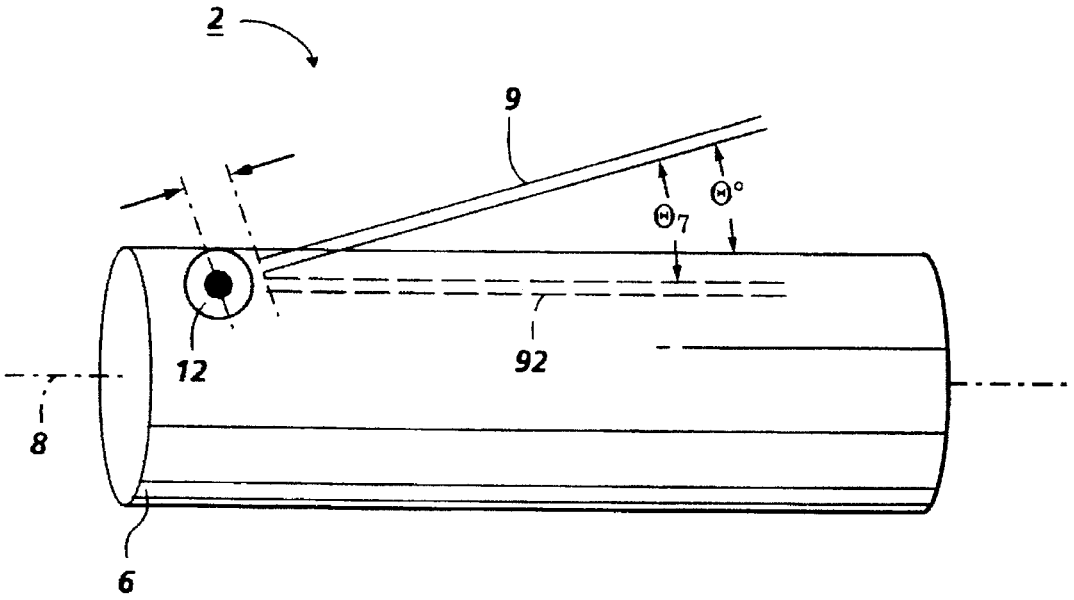
FIG. 4 shows a cross-jet for a fluid.

FIG. 4 shows a side view of drum 2 being laser ablated at spot 12 on coating 6. A high velocity cross-jet fluid 9 is directed at spot 12 to force molten coating material off the end of drum 2. As shown, cross-jet fluid 9 may be oriented at an angle θ° from the outer surface of coating 6. The angle θ° of orientation of cross-jet fluid 9 may range for example from about 0° to about 90° from the surface of coating 6, most preferably from about 15° to about 45°. The cross-jet fluid also has an angle $\theta_7$ associated with it, measured from the imaginary line 92 which represents the line on the surface of drum 2 which is parallel to the longitudinal axis 8 and which includes spot 12. This angle $\theta_7$ may range for example from about 15° to about 60°, preferably from about 30° to about 45°, and especially about 45°.

Figure 5:
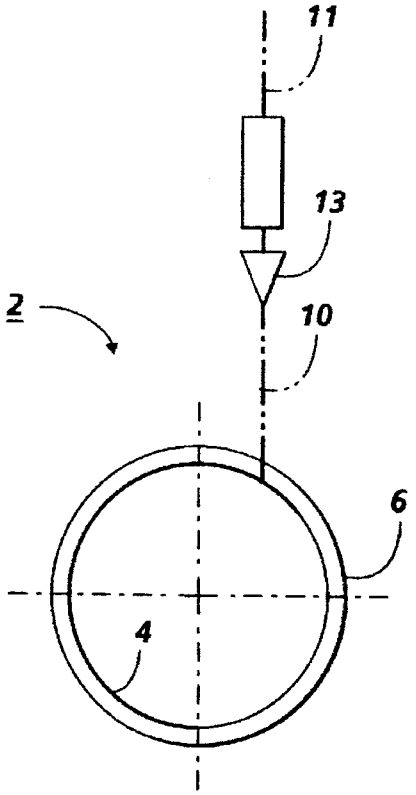
FIG. 5 illustrates a preferred orientation of laser ablation.

FIG. 5 illustrates a preferred laser orientation. Laser beam nozzle 13 is preferably oriented along axis 11 which is coincident with beam 10 such that laser beam 10 intersects both coating 6 and substrate 4. The laser beam can be directed at the coating at various angles to provide an adequate absorption of the laser energy by coating 6. Absorption of the laser energy by substrate 4 should be minimized. Also, the laser beam should not be directed along a diameter of photoreceptor 2 because this may cause the laser beam to reflect off of substrate 4 directly back into the laser, possibly damaging the laser.

Figure 6:
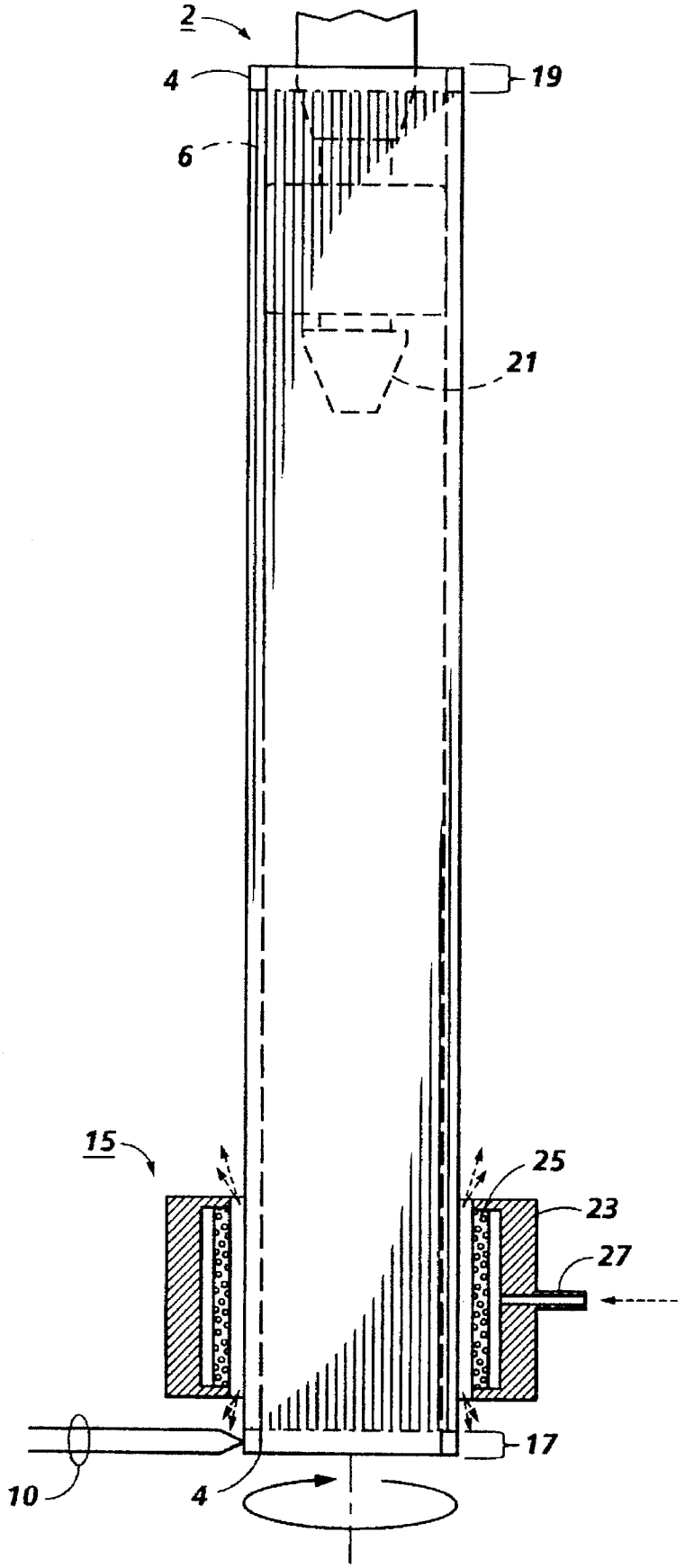
FIG. 6 illustrates a schematic, cross-sectional view of one embodiment of the invention.

FIG. 6 illustrates one embodiment of the instant invention where a single gas bearing 15 is positioned on the inboard side adjacent to the first end region 17 of the vertically disposed drum 2 comprised of substrate 4 and coating 6. The gas bearing 15 is positioned to expose the first end region 17 of drum 2 for the removal of the coating 6 by for instance the laser beam 10. For example, a length of the drum 2 is exposed to the laser beam 10 ranging for example from about 5 mm to about 50 mm, and preferably from about 10 mm to about 30 mm. In FIG. 6, the coating 6 at the first end region 17 has been removed by the laser beam. Optionally, a transport mechanism (not shown) may move either the gas bearing 15 or drum 2 to expose additional lengths of the drum 2 for removal of the corresponding portion of the coating. The second end region 19 of drum 2 is engaged and supported by any conventional chuck 21 including for example a chuck comprised of a shaft and inflatable rubber air bladders as disclosed in Fukuyama et al., U.S. Pat. No. 4,783,108, the disclosure of which is totally incorporated by reference. The drum 2 may be rotated via rotation of the engaged chuck 21.

The gas bearing is preferably a cylindrically-shaped, hollow air bearing and may have any suitable structure. Gas bearings can be custom built by for example Westwind Air Bearings Inc. of Ann Arbor, Mich. The gas bearing may include slots, holes, and/or porous material which admits the gas through the bearing to the drum. The gas employed by the bearing may be for example, air, nitrogen, oxygen, and the like. As illustrated in FIG. 6, the gas bearing 15 may include for instance an outer wall 23 and a porous inner wall 25 which is in communication with the gas inlet 27. The gas bearing may be coupled to another structure such as a brace (not shown) to support the gas bearing during its use. During operation, gas enters the gas bearing 15 via the gas inlet 27 and exits the bearing through a plurality of openings in its inner surface wherein the gas is directed against the surface of the drum 2 to provide a gas film around the circumference of the drum 2. The generally steady pressure of the gas film against the drum minimizes or eliminates swaying of the drum as it rotates. The arrows in FIG. 6 indicate escaping gas.

Figure 7:
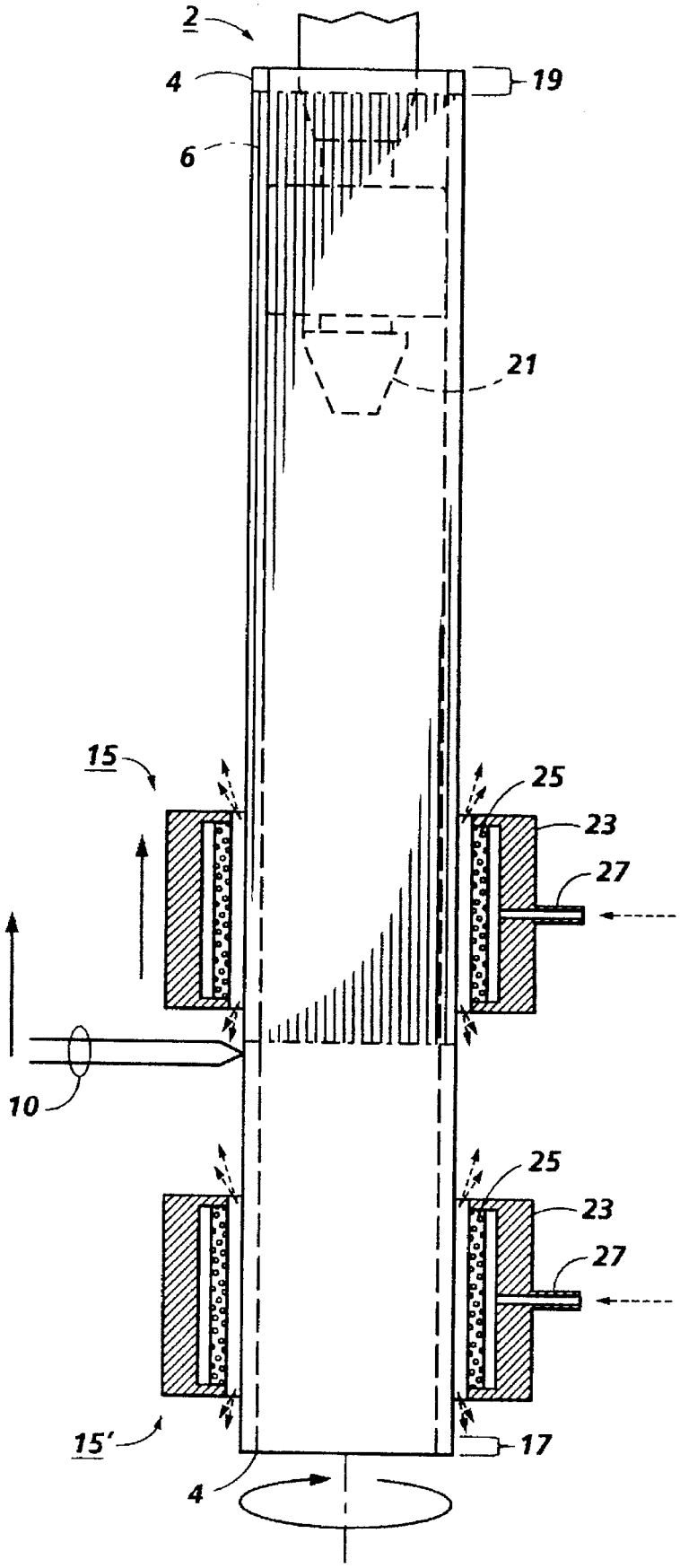
FIG. 7 illustrates a schematic, cross-sectional view of a second embodiment of the invention.

FIG. 7 illustrates an embodiment involving two gas bearings (15, 15') to support the drum having a first end region 17 and a second end region 19 during removal for instance of the entire coating 6 for recycling of the substrate. The two gas bearings may have the same or similar configuration as one another and each may have the same or similar configuration as the gas bearing of FIG. 6. The first bearing 15 is initially positioned adjacent to the first end region 17 of the drum 2 on the inboard side to provide support and to expose the first end region 17 for removal of the coating by the laser beam 10. The second bearing 15' is initially positioned at a distance away from the end of the drum. As the laser beam 10 traverses along the length of the drum 2 towards the second end region 19, removing the coating, the first bearing 15 also moves towards the second end region 19, thereby exposing additional lengths of the drum to the action of the laser beam. The second bearing 15' moves onto the drum 2 and is positioned at about the first end region 17 to support the drum as the laser beam moves further along the length of the drum. As the laser beam removes the coating along the entire length of the drum, the first bearing 15 eventually reaches and is positioned at about the second end region 19 while the second bearing 15' is positioned at about or adjacent to the first end region 17. The second end region 19 of drum 2 is engaged and supported by any conventional chuck 21 including for example a chuck comprised of a shaft and inflatable rubber air bladders as disclosed in Fukuyama et al., U.S. Pat. No. 4,783,108. In embodiments of the instant invention, the drum 2 may move in the direction of its longitudinal axis to expose additional portions of the coating to the laser beam.

In embodiments of the instant invention, the one or more gas bearings have the following illustrative characteristics: an annularly-shaped gap between the inner surface of the bearing and the outer surface of the drum ranging in distance for example from about 0.05 mm to about 1 mm, and preferably from about 0.10 mm to about 0.50 mm; a cleaniness of the gas ranging for example from about 100 ppm to about 800 ppm, and preferably from about 200 ppm to about 400 ppm; a gas outflow (volume of gas usage to operate system) ranging for example from about 20 to about 100 cubic feet, and preferably from about 30 to about 80 cubic feet; and a gas pressure ranging for example from about 5 psi to about 100 psi, and preferably from about 20 psi to about 40 psi.

The instant invention provides in embodiments several advantages. For instance, the gas bearing provides the support for the drum in a contactless and frictionless manner which minimizes damage to the coating. In addition, the gas bearing can provide such contactless and frictionless support to the drum while exposing the first end region, both inner and outer surfaces, to the action of the laser beam; a conventional chuck which extends through an end of the drum to grip its inner surface may physically interfere or block the laser ablation process on the drum's inner surface. Also, the bearing or bearings minimize or eliminate swaying of the drum during rotation, especially for small diameter drums experiencing swaying in a cantilevered state. Small diameter drums which may be used in embodiments of the instant invention may have the following illustrative dimensions: a substrate outer diameter ranging from about 10 mm to about 40 mm, and preferably from about 15 mm to about 30 mm; a wall thickness ranging from about 65 micrometers to about 3 mm, and preferably from about 0.05 mm to about 2 mm; and a length ranging from about 5 cm to about 20 cm, and preferably from about 7 cm to about 10 cm.

Other modifications of the present invention may occur to those skilled in the art based upon a reading of the present disclosure and these modifications are intended to be included within the scope of the present invention.

I claim:

1. A method comprising:

(a) rotating a hollow cylindrical substrate having a coating thereon;

(b) employing a gas bearing around the circumference of the rotating substrate along a portion of the length of the substrate to provide support to the substrate during its rotation; and (c) removing a portion of the coating while directing a fluid stream at the coating.

2. The method of claim 1, wherein (a) comprises rotating the substrate having the coating comprised of a photoconductive material.

3. The method of claim 1, wherein (a) comprises rotating the substrate at a speed ranging from about 400 to about 4,000 rpm.

4. The method of claim 1, wherein (a) comprises rotating the substrate having an outside diameter ranging from about 10 mm to about 40 mm.

5. The method of claim 1, wherein (b) comprises positioning the gas bearing adjacent to an end region of the substrate.

6. The method of claim 1, wherein (b) comprises employing the gas bearing to provide an air film around the substrate.

7. The method of claim 1, wherein (c) comprises employing a laser beam to remove the portion of the coating.

8. The method of claim 1, wherein (c) comprises removing all of the coating.

9. The method of claim 1, wherein the coating covers all of the outer surface of the substrate except at one end region of the substrate, and wherein (c) comprises removing the portion of the coating at the other end region of the substrate.

10. The method of claim 1, wherein the coating covers a part of the inner surface of the substrate and wherein (c) comprises removing the coating over the inner surface.

11. The method of claim 1, further comprising moving the gas bearing in the direction of the longitudinal axis of the substrate to expose additional coating to be removed in (c).

12. The method of claim 1, further comprising moving the substrate in the direction of its longitudinal axis to expose additional coating to be removed in (c).

* * * * *